US009556529B2

(12) United States Patent
Wallevik et al.

(10) Patent No.: US 9,556,529 B2
(45) Date of Patent: Jan. 31, 2017

(54) ELECTROLYSER FRAME CONCEPT, METHOD AND USE

(75) Inventors: Oddmund Wallevik, Skien (NO); Hans Jörg Fell, Sandefjord (NO); Petr Chladek, Brevik (NO)

(73) Assignee: New NEL Hydrogen AS, Notodden (NO)

( * ) Notice: Subject to any disclaimer, the term of this patent is extended or adjusted under 35 U.S.C. 154(b) by 227 days.

(21) Appl. No.: 14/233,607

(22) PCT Filed: Jul. 20, 2012

(86) PCT No.: PCT/NO2012/050141

§ 371 (c)(1),
(2), (4) Date: Jun. 4, 2014

(87) PCT Pub. No.: WO2013/012342

PCT Pub. Date: Jan. 24, 2013

(65) Prior Publication Data

US 2014/0305794 A1 Oct. 16, 2014

(30) Foreign Application Priority Data

Jul. 20, 2011 (NO) ..... 20111046
Jul. 20, 2011 (NO) ..... 20111048

(51) Int. Cl.
*C25B 9/20* (2006.01)
*C25B 9/02* (2006.01)

(52) U.S. Cl.
CPC *C25B 9/206* (2013.01); *C25B 9/02* (2013.01)

(58) Field of Classification Search
CPC ..... C25B 9/206
USPC ..... 264/262
See application file for complete search history.

(56) References Cited

U.S. PATENT DOCUMENTS 4,530,743 A 7/1985 deNora
4,729,822 A * 3/1988 James ..... C25B 9/206 204/255
4,758,322 A * 7/1988 Sioli ..... C25B 9/203 204/253
4,784,741 A * 11/1988 Boulton ..... C25B 9/00 204/242
4,915,803 A 4/1990 Morris
5,178,712 A * 1/1993 Sakai ..... F21V 7/22 156/293

(Continued)

FOREIGN PATENT DOCUMENTS

EP 0 212 240 7/1986
EP 0 545 548 A1 2/1992

(Continued)

OTHER PUBLICATIONS

Machine translation of JP 2009-199906 A.*

(Continued)

*Primary Examiner* — Harry D Wilkins, III
(74) *Attorney, Agent, or Firm* — Brinks Gilson & Lione

(57) ABSTRACT

The present invention comprises a module for an electrolyzer of filterpress type comprising at least one closed frame defining at least one first opening, wherein said module comprises a sealing and electric insulating material, wherein said material at least partly covers the surface of the frame. In addition the present invention comprises a method for producing a module for an electrolyzer of filterpress type and use thereof.

22 Claims, 4 Drawing Sheets

(56) References Cited

U.S. PATENT DOCUMENTS

| | | | | |
|---|---|---|---|---|
| 5,919,344 | A * | 7/1999 | d'Erasmo | C25B 9/20 204/252 |
| 6,554,978 | B1 | 4/2003 | Vandenborre | |
| 7,404,884 | B2 | 7/2008 | Montminy et al. | |
| 2001/0035595 | A1 | 11/2001 | Gemberling | |
| 2002/0106551 | A1* | 8/2002 | Speranza | C25B 9/08 429/130 |
| 2004/0253519 | A1 | 12/2004 | Oldani et al. | |
| 2006/0131167 | A1 | 6/2006 | Ramisch et al. | |
| 2007/0193880 | A1 | 8/2007 | Schick et al. | |
| 2009/0301871 | A1 | 12/2009 | Zappi et al. | |
| 2010/0108537 | A1 | 5/2010 | Perego et al. | |
| 2010/0187102 | A1 | 7/2010 | Schmitt et al. | |

FOREIGN PATENT DOCUMENTS

| | | | |
|---|---|---|---|
| EP | 0 545 548 | A1 | 11/1992 |
| EP | 0 545 548 | A1 | 6/1993 |
| EP | 0 833 963 | B1 | 6/1996 |
| EP | 0 833 963 | B1 | 3/1999 |
| EP | 1 882 758 | A1 | 5/2006 |
| EP | 2065958 | A1 | 6/2009 |
| GB | 1145751 | | 1/1965 |
| GB | 1145715 | | 7/1967 |
| JP | 62-161974 | A | 7/1987 |
| JP | 63-086884 | A | 4/1988 |
| JP | 2002-155647 | A | 5/2002 |
| JP | 2009-199906 | A * | 9/2009 |
| WO | WO 97/00979 | | 6/1996 |
| WO | WO 01/48852 | A1 | 7/2001 |
| WO | WO 2010/078952 | A2 | 7/2010 |

OTHER PUBLICATIONS

"Mechanical connection", accessed at http://encyclopedia2.thefreedictionary.com/mechanical+connection, accessed on Sep. 8, 2016.*

PCT Written Opinion of the International Searching Authority for International Application No. PCT/NO2012/050141, 6 pgs.

PCT Int'l Search Report for International Application No. PCT/NO2012/050141, mailing date Jan. 30, 2013, 5 pgs.

Japanese Office Action issued May 17, 2016 for Japanese Application No. 2014-521587.

* cited by examiner

ELECTROLYSER FRAME CONCEPT, METHOD AND USE

This application claims the benefit under 35 U.S.C. §371 of International Application No. PCT/NO2012/050141, filed Jul. 20, 2012, which claims the benefit of Norwegian Patent Application No. 20111046 filed Jul. 20, 2011, and Norwegian Patent Application No. 20111048 filed Jul. 20, 2011, which are incorporated by reference herein in their entirety.

INTRODUCTION

The present invention comprises a module and a method for producing an electrolyser of filterpress type comprising at least one closed frame defining at least one first opening and use thereof. Further the present invention comprises use of a pressure element.

BACKGROUND OF THE INVENTION

Electrolysers of filter press type are commonly used for the production of hydrogen and oxygen from brines and lyes, usually aqueous alkali hydroxide solutions. Cell stacks in such configurations are formed by electrochemical cells which commonly consist in sequence of a bipolar plate, first electrode (anode or cathode), a steel frame with a diaphragm, referred to as the diaphragm element, said diaphragm element separates the cell into anode and cathode compartment, a second electrode and a new bipolar plate. Gaskets are used for sealing purposes.

The manufacturing of inter alia diaphragm elements comprises both mechanical and/or manual fastening of the diaphragm to a frame and requires in addition gaskets to form a sealed cell stack. Another prior art embodiment comprises a moulding process to cover a steel frame with rubber and in such an assembly the bipolar plate is the load carrying element. The steel frame in the diaphragm element is only a means of fastening diaphragms while the rubber on the frame serves as gasket between neighbouring bipolar plates. Further, this existing assembly requires bipolar plates which have an outer diameter at least equal to that of the diaphragm frame thus covering the whole frame. As the bipolar plates are made of steel, this leads under normal operation to secondary electrolysis in the gas channels thereby reducing the gas quality. The existing assembly requires manual stacking where each element is placed in a vertical position. In the mentioned prior art embodiment the diaphragm elements with the integrated gasket form the seal between two bipolar plates. The mentioned embodiments are not suitable for pressurised operation. An increased internal pressure has to be compensated solely by the force exerted by bolts connecting the endplates arranged at each end of the stack. Hence an increased internal pressure may easily lead to leakages. The bipolar plates are supporting the electrolyser, but also bring the electrical potential to the outside of the electrolyser and complicate the electrical insulation of the device.

EP0833963B1 describes steel frames covered by vulcanizable material, i.e., rubber. This rubber serves as electrical insulation and as sealing material. The diaphragm is bolted to the rubber covered frame. Furthermore, a T-shaped element that forms the lye channels is bolted to the frame.

U.S. Pat. No. 6,554,978 discloses a high pressure electrolyser and frames thereof. The frames can be made of metal with a non-conducting layer or of a synthetic material. A separate gasket is included between the frames in the disclosed embodiments.

GB1145751 describes an electrolyser built up of frames that are formed of a hardenable mouldable material; examples of this material are cement, ceramic, thermosetting resin, thermoplastic materials. A separator may be integrally moulded to the frame ring. Rubber O-rings are included to provide the sealing between the frame and adjacent elements.

Traditionally electrodes are mounted by solid spacer, serving as a current collector, to the bipolar plate and there is a gap between electrode and diaphragm where gas bubbles are formed and escape into the gas collecting chambers.

According to prior art mounting of electrodes on bipolar plate is time-consuming and expensive. The gas-tightness of bipolar plate is compromised by drilling-through, which may lead to gas leakages especially during the pressurized operation. In addition current is concentrated in fewer spots which lead to non-uniform current distribution across the electrodes. Further, rigid fixing of electrode prevents intimate and adjustable contact of electrode with membrane as in a zero gap design, thus increasing the ohmic resistance and decreasing the efficiency of the electrolysis.

Processes concerning modules for electrolysers of filterpress type and for manufacturing of diaphragm elements according to prior art are laborious and demanding as many separate elements has to be fitted together.

SUMMARY OF THE INVENTION

The present invention is conceived to solve or at least alleviate the problems identified above.

The object of the present invention is to provide a module and method for an electrolyser of filterpress type comprising at least one closed frame defining at least one first opening and use thereof. The object of the present invention is to provide one or more of the following advantages:

- the module comprising at least one closed frame can be a load carrying element,
- the module as such is universal and can be assembled horizontally or vertically,
- the bipolar plates can have a smaller diameter than at least one first opening,
- the bipolar plates can have a smaller diameter than the diaphragm,
- the bipolar plates can have a smaller diameter than the outer diameter of the module,
- the sealing of the stack is even enhanced when high pressure is applied thus reducing the possible leaking of electrolyte,
- the insulation of the bipolar plates from the outside is obtained by stacking,
- the diameter of the module is variable and can be produced in the required size e.g., diameter from 0.10 m to 5.00 m.
- the module is symmetrical i.e., it can be used with oxygen or hydrogen producing electrodes on either of the sides,
- the stacking of the module(s) can be made manually, semiautomatic or automatic,
- the present method concerning the placing of at least one first element around at least one closed frame by a sealing and electric insulating material can be regarded as a one step manufacturing process,
- at least one first element can be fully integrated in the module,
- no bolting or other type of mounting is necessary,
- secondary electrolysis is suppressed. efficient stacking in an electrolysis cell stack and suitable for automated stacking, enabling zero-gap when stacked in an electrolysis cell leading to lower ohmic resistance and thus higher energy efficiency in an electrolysis cell, effective gas transport when used in an electrolysis cell and thereby higher efficiency for the production of preferred gases, i.e., higher production capacity, enhanced current distribution and in addition higher efficiency and better local temperature control in an electrolysis cell, inherent gas-impermeable bipolar plate and further improved safety, steady tension between electrode and diaphragm in pressurized operation.

The present invention comprises a module for an electrolyser of filterpress type comprising at least one closed frame defining at least one first opening, wherein said module comprises a sealing and electric insulating material, where said material at least partly covers the surface of the frame. Further, said material provides sealing against a possible adjacent module or an end section of said electrolyser. The mentioned frame constitutes at least one of the following: metal, structured plastic, reinforced plastic, thermoset plastic. According to the present invention the module comprises at least one positioning means. Furthermore, according to the present invention the module comprises optionally at least one positioning means provided at the inner edge of said module. The positioning means may function as a receiving means for possible desired elements. The positioning means can also be provided in the central part of the surface of the module. It should also be understood that positioning means also comprises inter alia supportive recess, support structure, notch or a groove around optionally the inner edge of the module. The positioning means can be provided at the outer edge of the module in which the positioning means may be used together with a helping tool i.e., during orientation of the module. The positioning means may also be optional. The module according to the present invention comprises at least one supply channel in which at least one supply channel is covered with a sealing and electric insulating material. At least one supply channel is connected with at least one first opening by at least one separate transfer channel. Further, at least two separate transfer channels are connected to each side of the at least one first opening. According to the present invention said module mentioned above further comprises at least two separate collecting channels in which said at least two separate collecting channels are covered with a sealing and electric insulating material. Said at least two separate collecting channels are connected with at least one first opening by at least one separate transfer channel. At least two separate transfer channels are each connected to each side of said at least one first opening. In the present invention said at least one first opening can be completely or partly covered by at least one first element. Further, said at least one first element is placed around at least one closed frame by a sealing and electric insulating material. It should be understood that the wording placed around comprises at least one of the following: placed on, fixed to, attached to, removably attached to. Said at least one first element is chosen among at least one of the following: diaphragm, bi-polar plate, pressure element, electrodes. The module according to the present invention constitutes a load carrying part of the electrolyser. Said module of the present invention constitutes of mouldable sealing and electric insulating material. Further, said module constitutes a pre-moulded sealing of electric insulating material. The pre-moulded sealing can be thread around said frame.

The present invention also comprises a method for producing a module for an electrolyser of filterpress type comprising at least one closed frame defining at least one first opening, which at least partly is covering the surface of said frame with a sealing and electric insulating material. The present method may be regarded as a one-step manufacturing process. Further, the present invention provides sealing with said material against a possible adjacent module or an end section of said electrolyser. Said frame constitutes at least one of the following materials: metal, structured plastic, reinforced plastic, thermoset plastic. Further, the present invention provides at least one positioning means. The expression positioning means should be understood as comprising supportive recess, support structure or a groove. The positioning means may function as a receiving means for possible desired elements. The positioning means can also be provided in the central part of the surface of the module. It should also be understood that the positioning means also comprises inter alia supportive recess, support structure, notch or a groove around optionally the inner edge of the module. The positioning means can be provided at the outer edge of the module in which the positioning means may be used together with a helping tool i.a. during orientation of the module. The positioning means may also be optional Further, the present method is providing at least one supply channel in said module in which said at least one supply channel is covered with a sealing and electric insulating material. According to the present method at least one supply channel is being connected with at least one first opening by at least one separate transfer channel. In addition, at least two separate transfer channels are being connected to each side of the at least one first opening. Said module further comprises at least two separate collecting channels in which said at least two separate collecting channels are being covered with a sealing and electric insulating material. In the present method said at least two separate collecting channels are being connected with at least one first opening by at least one separate transfer channel. Further, at least two separate transfer channels are being connected to each side of said at least one first opening. The collecting channels, supply channels and transfer channels are prepared by one of the following methods or by their combination: moulding, post-moulding. The wording post-moulding of the present invention should be understood as comprising drilling, laser cutting, water-jet cutting or any other manual or automatic suitable method for producing channels. Further, said at least one first opening being completely or partly covered by at least one first element. Said at least one first element is being placed around the at least one closed frame by a sealing and electric insulating material. It should be understood that the wording placed around comprises at least one of the following: placed on, fixed to, attached to, removably attached to. Said module comprises mouldable sealing and electric insulating material or said module comprises a pre-moulded sealing of electric insulating material. Further, said at least one first element is chosen among at least one of the following: diaphragm, bi-polar plate, pressure element, electrodes. According to the present inventive method said module constitutes a load carrying part of the electrolyser. The present invention comprises a one-step manufacturing process.

The present invention also comprises use of at least one closed frame defining at least one first opening by at least partly coating the surface of said frame with a sealing and electric insulating material for an electrolyser of filterpress type.

It should be understood that sealing and electric insulating material according to the present invention may constitute any material or blend of materials commonly known to a person skilled in the art suitable for the intended purpose.

In addition the present invention comprises a module as described above in which said pressure element is a fluid-permeable and resilient pressure element. The pressure element possesses an inherent conductivity and further tolerates current density from 0 to 5 A/cm$^2$. According to the present invention said pressure element tolerates a compression pressure in at least one of the following ranges: 0.001 to 100 bar, 0.01 to 50 bar, 0.1 to 1.0 bar. The pressure element is fluid permeable in at least two dimensions and is resistant to corrosion. Furthermore the pressure element comprises at least one of the following components: stretched material, perforated foil, mesh or felt fibre mat. Use of a resilient fluid-permeable pressure element applied between an electrode and a bipolar plate in an electrolyser cell is also comprised in the present invention.

The present invention comprises a pressure element for an electrolysis cell comprising a fluid-permeable pressure element applied between an electrode and a bipolar plate in said electrolysis cell, in which said pressure element is resilient. The pressure element of the present invention possesses an inherent conductivity. Further, said pressure element tolerates current density from 0 to 5 A/cm$^2$. In addition said pressure element tolerates a compression pressure in at least one of the following ranges: 0.001 to 100 bar, 0.01 to 50 bar, 0.1 to 1.0 bar. The pressure element of the present invention is fluid permeable in at least two dimensions. Furthermore, the said pressure element comprises at least a two dimensional structure. In this regard it should be understood that said pressure element can also comprise a three-dimensional structure the strength and permeability of which can be such that fluid flow is unrestricted in three dimensions. The pressure element is resistant to corrosion. The pressure element comprises at least one of the following components: stretched material or perforated foil. Furthermore the pressure element comprises at least one of the following components: mesh or felt fiber mat. At least one component material according to the present invention is chosen among at least one of the following: metal, polymer or carbon. The metal is chosen among at least one of the following: nickel, nickel coated steel, nickel containing alloys. With regard to the present pressure element said at least one component material is prepared in one of the following manners: knitted, woven, interwoven, perforated and stretched, rolled and/or pressed. In addition at least one component material is further prepared in at least one of following manners: pleating, embossing, corrugating, or rolling. The fluid permeable pressure element comprises openings in one of the following ranges: 0.05-20 mm, 0.5-5 mm, 1-2 mm.

The pressure element according to the present invention comprises at least one component material such as mesh or felt fibre mat in the form of at least a wire, in which a predetermined wire thickness is a function of the opening as follows:

$$\sqrt[3]{2 * \text{opening (mm)}} * A = \text{wire thickness (mm)}$$

where parameter A is chosen from one of the following ranges: 0.01-10, 0.1-1, 0.1-0.3. A is a parameter which relates mesh opening to the wire thickness, without limitation to only 1 wire dimension for any given opening. The values of parameter A originate from the experimental data and outside of the given ranges, the element will not have sufficient mechanical strength.

The pressure element according to the present invention is in the corrugated form comprising a wave height in the range of at least one of the following: 3-50 mm, 5-20 mm, 6-15 mm. Further the ratio wave length:wave height is in at least one of the following ranges: 0.1-10, 0.5-5, 1-3.

Use of a resilient fluid-permeable pressure element applied between an electrode and a bipolar plate in an electrolysis cell is also comprised by the present invention.

SUMMARY OF THE DRAWINGS

FIG. 1 illustrates an expanded view of a prior art electrolyser cell. Electrolysers of filter press type are commonly used for the production of hydrogen and oxygen from brines and lyes, usually aqueous alkali hydroxide solutions. Cell stacks in such configurations are formed by cells which commonly consist of bipolar plates, electrodes (anode and cathode), a steel frame with a diaphragm placed between two bipolar plates, separating anode and cathode compartment and gasket(s) for sealing purposes.

Figure 1:
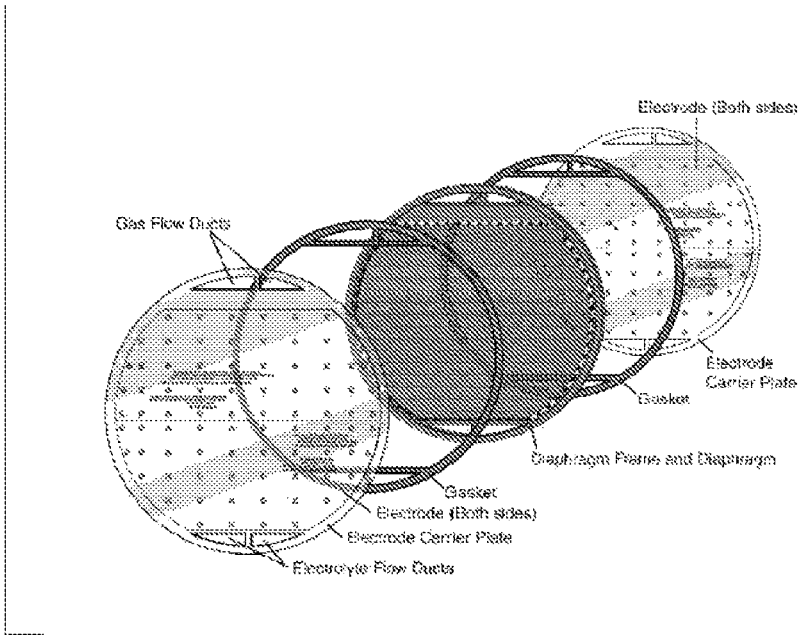
Fig. 1 Prior Art
FIG. 1 illustrates an expanded view of electrolyser cell according to the prior art. The bolting is not shown in FIG. 1.
Figure 2:
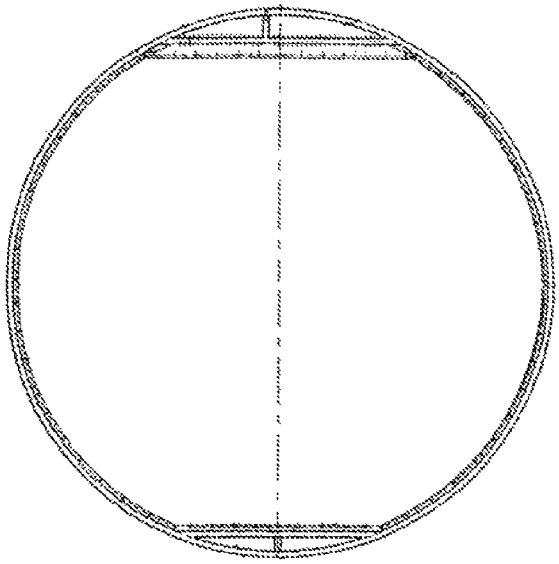
Fig 2 Prior Art
FIG. 2 illustrates a detailed view of electrolyser cell according to prior art. The bolting is not shown in FIG. 2.

These steel frames can be covered by vulcanizable material, i.e., rubber. This rubber serves as electrical insulation and as sealing material. Patent EP0833963B1 describes a configuration whereby the rubber frames have an integrated fastening means for bolting the diaphragm to the frame. Furthermore, T-shaped elements forming lye channels are bolted to the frame and are also covered by vulcanizable material and thus form an integral part of the frame, see FIG. 2. The bolting and fastening of the mentioned components are not shown in FIG. 1 or 2.

DETAILED DESCRIPTION

The present invention comprises a module consisting of a at least one frame as mentioned above which is partly covered with a sealing and electric insulating material and said frame and material constitutes the load carrying part of the electrolyser. The module of the present invention is universal in the meaning it can be used with oxygen or hydrogen producing electrodes on either of the sides. Furthermore it can be stacked manually, semi automatic or automatic.

The insulation of the bipolar plates from the outside is obtained by stacking as the bipolar plate becomes completely retained within the said module and isolated from the outside.

The O-ring effect is obtained by stacking said modules and operating the electrolyser at elevated pressures. O-ring effect contributes to the minimization of the risk of leakages.

In one aspect of the present invention a one step process for manufacturing modules comprises at least one closed frame and at least one first element such as e.g., diaphragm, bipolar plate, pressure element and/or electrodes where the one step process should be understood as moulding the first element and the frame together utilizing a vulcanizable material thereby simultaneously placing the at least one first element around the at least one frame, insulating the frame and providing sealing. The gaskets can be regarded as built into the module according to the present invention. It should be noted that at least one first element can be fully integrated in the present module.

In one aspect of the present invention a one step process for manufacturing modules comprises at least one closed frame and at least one first element such as e.g., diaphragm, bipolar plate, pressure element and/or electrodes, where the one step process should be understood as comprising a pre-moulded sealing of electric insulating material which is placed around/threaded around the first element and the frame thereby simultaneously fixing the constituents, the at least one frame and the at least one element, insulating the frame and providing sealing. The gaskets can be seen as built into the module according to the present invention. It should be noted that at least one first element can be fully integrated in the present module.

Accordingly no bolting, no fastening, no gluing, no welding of the first element to the frame is required concerning the present invention.

A further aspect of the invention is the compact design due to the reduced number and size of constituent parts that need to be stacked. The present design of the invention can be seen as a compact design which is well suited for zero gap design, where electrodes are in intimate contact with a diaphragm.

The bipolar plates can have a smaller diameter than at least one first opening. The bipolar plates can have a smaller diameter than the outer diameter of the module.

The diameter of the module is variable and can be produced in the required size: e.g., diameter from 0.10 m to 5.00 m. Some ranges of the required size given in meters of the mentioned diameter is as follows: 0.1-0.5; 0.5-1; 1-1.5; 1.5-2; 2-2.5; 2.5-3; 3-3.5; 3.5-4; 4-4.5; 4.5-5.

The present invention will be described in detail with reference to the enclosed FIG. 3. The present module comprises a first opening being completely or partly covered by at least one first element e.g., a diaphragm, and at least one closed frame e.g., steel frame being at least partly covered by vulcanizable or other mouldable material characterised by its electrical insulation and mechanical sealing properties. The diaphragm is fastened by vulcanizable material being cast onto the edges of diaphragm and onto the steel frame and not by a separate mechanical device or by bolting to the frame, see FIG. 3. The supply- and collecting channels forming the lye and gas ducts are made of a vulcanizable/mouldable material. The present module including e.g., the diaphragm element is made in a one manufacturing step whereby moulding or threading the vulcanisable material around the steel frame, simultaneously fastening e.g., the diaphragm and forming the at least one supply channel, the at least two collecting channels and the transfer channels. Geometrical, the supply- and collecting channels can be either fully symmetric or alternatively asymmetric. The transfer channels connecting the first opening with the supply and the collecting channels can be made in two ways:

1) Moulded as profiles of sealing and electric insulating material such as inter alia rubber profile so that channels are formed by intimate contact of rubber with bipolar plate.

2) Transfer channels penetrating the sealing and electric insulating material such as inter alia rubber and formed either in the moulding process or by post-moulding.

There is optionally a positioning means such as a groove around the inner edge of the module to accommodate the bipolar plate. The frame is completely isolated from the electrolyte and gases, thus no high quality steel is needed for pressurised components and the secondary electrolysis is suppressed. The frame which is at least partly covered by a sealing and electric insulating material e.g., rubber is the load carrying element.

The diaphragm can be cast into the module. The cell stack is made of in sequence rubber frame module with diaphragm, first electrode, first pressure element, bipolar plate, second pressure element, second electrode, rubber frame module with diaphragm.

The bi-polar plates can be cast into the module. The cellstack module is made of in sequence rubber frame module with bipolar plate, first pressure element, first electrode, diaphragm, second electrode, second pressure element and rubber frame module with bipolar plate.

The electrode can be cast into the module. The cell stack is made of in sequence rubber frame module with first electrode, diaphragm, rubber frame module with second electrode, first pressure element, bipolar plate, second pressure element.

The pressure element can be cast into the module. The cell stack is made of in sequence rubber frame module with first pressure element, first electrode, diaphragm, second electrode, rubber frame module with second pressure element, bipolar plate.

The pressure bearing element with collecting channels can be the vulcanised rubber covered steel frame without diaphragm or bipolar plate: The cell is made of in sequence bipolar plate, rubber frame module, first pressure element, first electrode, diaphragm, second electrode, second pressure element and second rubber frame module.

According to the present invention a cell stack module comprising a number of cell constituent parts such as electrodes, placed between endplates is possible. The end plates are fastened with tie rods. The fastening of the endplates of the electrolysers must not be mixed with the bolting mentioned in prior art. In addition, no spring system is needed in the present invention to assure tightness of the present modules constituting the electrolyzer. The system can be operated under pressure as it is a self-sealing system. When the modules are made of elastic material, the rubber frame module stacked is self-sealing under pressurized conditions (O-ring effect). The stack does not need to be tightened/compressed with a force corresponding to the force of the internal pressure. The rubber modules are provided with an area for placing batch number. From the perspective of operating an electrolyser stack made of such modules, the modules do not need to be covered completely by vulcanizable material on the outside. This allows a fixation of the frame during the high injection pressures of the moulding process. While the moulding-in of the frame, e.g., steel frame, eliminates the post-moulding shrinkage of the rubber modules, the modules can also be made by a steel frame and a separate pre-moulded rubber module which can be threaded over the steel frame after being moulded.

Optionally all contacting surfaces are equipped with ridges to secure complete tightness between the components and channels.

The present invention provides one embodiment comprising a fully-integrated diaphragm element based on steel frame with rubber surface and moulded-in diaphragm and lye/gas channels formed by the rubber.

Figure 3:
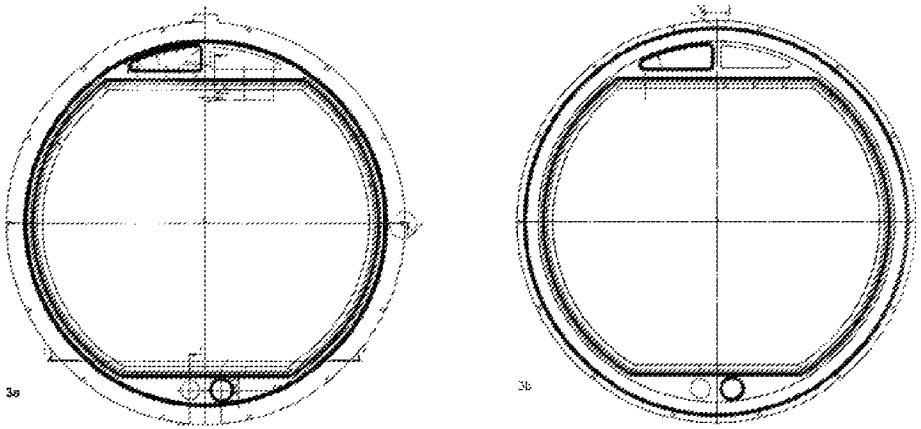
FIG. 3 illustrates a frame according to the present invention. Each side of the rubber frame shown in the drawings 3*a* and 3*b* can function as a cathode or an anode space.

FIG. 3 shows a module consisting of a diaphragm and a frame covered completely by vulcanizable or other mouldable material characterised by its electrical insulation and mechanical sealing properties. The diaphragm is fastened by vulcanizable material being cast into the diaphragm and steel frame and not by a separate mechanical device or by bolting to the frame The frame may have a smooth surface or it may be provided with grooves or similar to enhance the adhesion force of the rubber to the frame.

In one embodiment of the present invention the collecting channels within the circular module are functioning as gas flow ducts which do not comprise an inner metal element but are fully formed of the mouldable material.

In one embodiment of the present invention a pressure element in the form of a metal mesh of well-defined geometry is described to have following functions: reducing ohmic resistance by keeping the electrode in intimate contact with the diaphragm, conducting electrical current from bipolar plate to electrode and permitting gas to escape from the electrode surface.

The pressure element of the present invention is resilient, by resilient it should be understood, that the mechanical and geometrical properties of the said pressure element, e.g., a metal mesh, are balanced with regard to flexibility and stiffness in order to press the electrode to the diaphragm at all operational temperatures and not deform during cell assembly. The metal mesh has sufficient mesh opening to allow for non-hindered passing of fluid in both horizontal and vertical directions while maintaining the mechanical function.

Figure 6:
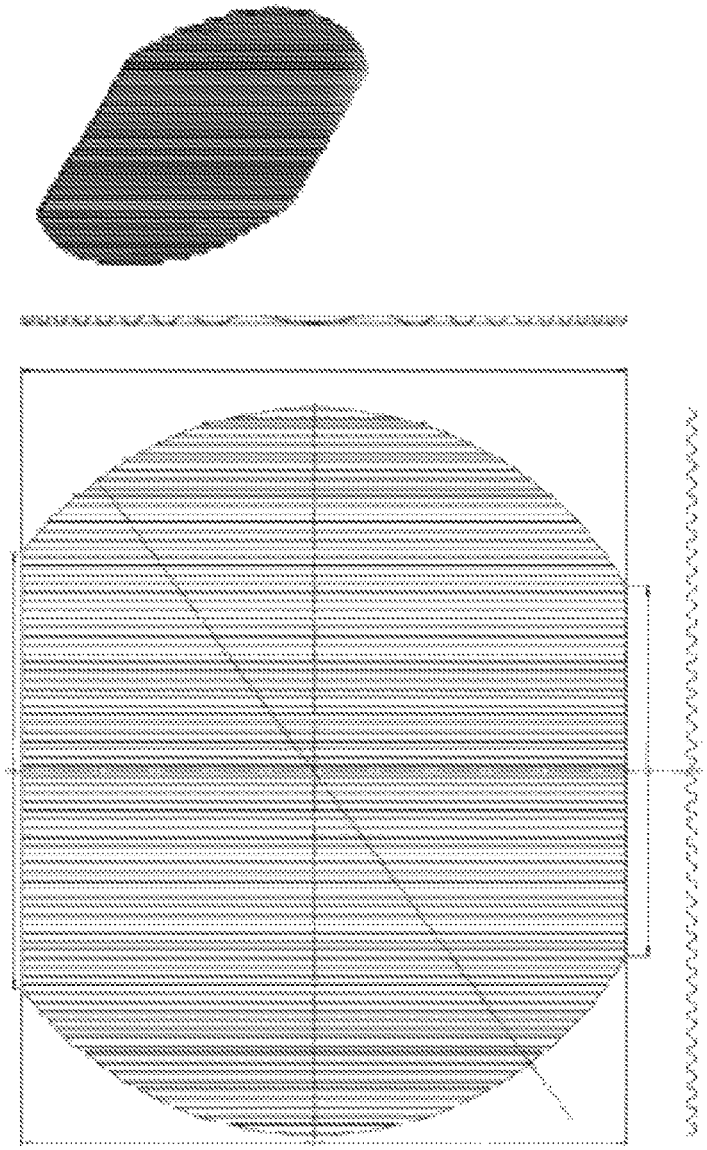
FIG. 6 illustrates one embodiments of the present pressure element.

In one embodiment of the pressure element the pressure element is in the corrugated form. The wording corrugated form should be understood as any wave form such as i.a. sinus wave or square wave. FIG. 6 shows a sinus wave.

In one embodiment the mesh or felt fibre mat can be described by the following properties:

Wire thickness is function of mesh opening and is defined by this function:

$$\sqrt[3]{2 * \text{opening (mm)}} * A = \text{wire thickness (mm)},$$

with parameter A being chosen from one of the following ranges: 0.01-10, 0.1-1, 0.1-0.3. A is a parameter which relates mesh opening to the wire thickness, without limitation to only 1 wire dimension for any given opening. The values of parameter A originate from the experimental data and allow the person skilled in the art to reproduce the results. Outside of the given ranges, the element will not have sufficient mechanical strength.

Height of the mesh—height is a function of maximum production capacity of the electrolyser.

Angle of the wave walls (limited by desired mechanical strength: sharp=stiff+deforming, dull=too weak+flattening): 10-120°, preferably 20-100°, most preferably 30-50°.

Distance between the waves maxima: given by angle and height.

Diameter of circle at top of the wave: given by angle and height.

The present pressure element comprises a combination of mechanical strength, current conductivity, chemical resistance and minimum gas diffusion resistance due to the different optimized geometries as described in more detail in the following. The pressure element is supplied in one piece, which can be manually or automatically inserted between a bipolar plate and an electrode in an electrolysis cell thus simplifying the stacking. When a pressure element according to the present invention is inserted on each side of a bipolar plate, conduction of current is ensured between the bipolar plate and the electrodes, without compromising the mechanical integrity of said bipolar plate. In the present invention, large numbers of points of electrical contact are established leading to uniform current distribution by pressing the pressure element to the electrode surface. The obtained optimized wave function of the present pressure element provides required spring force to keep electrode in intimate contact with a diaphragm regardless of distance variation due to temperature/pressure variation, thus maintaining the zero gap and low ohmic resistance. Further, free transport of the produced gas in both vertical and horizontal direction, thus ensuring an efficient removal of gas from inner electrode-bipolar plate area is achieved according to the present invention.

In an electrolyser of filter-press design, the compression force (force needed to compress the cell stack) is the sum of the force required to seal the stack and the force needed to compress the pressure elements. The compression force is decisive for the design of the end lids of the electrolyser. In case of pressurized systems the design of the end lid would need to take into account the operation pressure.

The compression of the pressure elements, however, acts in concert with the internal pressure and if the compression force of the pressure elements becomes substantial, this will have direct impact on the design of lids and tie rods of an electrolyser. According to the present invention a pressure element comprising specific features and properties has been invented. The present pressure element tolerates a compression pressure in the range 0.001 to 100 bar. In one embodiment the present pressure element withstands a maximum compression pressure of roughly 1 bar, and the typical pressure exerted by the pressure elements is in the range of 0.2-0.5 bar, which constitute about 1-2% of the design pressure of an electrolyser. The impact of the present pressure elements on the design of the end lids of the electrolyser is thus insignificant. Even used under atmospheric conditions, the current pressure elements would have minor impact on the lid design.

In one embodiment of the present invention the different parts can be stacked as follows:

a closed frame defining at least one first opening in which one first element is chosen as a diaphragm, in which said frame is partly covered with a sealing and electric insulating material;

a first electrode;

a first pressure element;

a bipolar plate;

a second pressure element;

a second electrode;

a closed frame defining at least one first opening in which one first element is chosen as a diaphragm, in which said frame is partly covered with a sealing and electric insulating material.

In one embodiment of the present invention the different parts can be stacked as follows:

a closed frame defining at least one first opening in which one first element is chosen as a bipolar plate, in which said frame is partly covered with a sealing and electric insulating material;

a first pressure element;

a first electrode;

a diaphragm;

a second electrode;

a second pressure element;

a closed frame defining at least one first opening in which one first element is chosen as a bipolar plate, in which said frame is partly covered with a sealing and electric insulating material.

In one embodiment of the present invention the different parts can be stacked as follows:

a diaphragm;

a closed frame defining at least one first opening, in which said frame is partly covered with a sealing and electric insulating material;

a first electrode;

a first pressure element;

a bipolar plate, a second pressure element;

a second electrode;

a closed frame defining at least one first opening, in which said frame is partly covered with a sealing and electric insulating material;

a diaphragm.

In one embodiment of the present invention the different parts can be stacked as follows:

a closed frame defining at least one first opening in which one first element is chosen as a pressure element, in which said frame is partly covered with a sealing and electric insulating material;

a first electrode;

a diaphragm a second electrode;

a closed frame defining at least one first opening in which one first element is chosen as a pressure element, in which said frame is partly covered with a sealing and electric insulating material;

a bipolar plate.

In one embodiment of the present invention the different parts can be stacked as follows:

a first pressure element;

a closed frame defining at least one first opening in which one first element is chosen as a first electrode, in which said frame is partly covered with a sealing and electric insulating material;

a diaphragm;

a closed frame defining at least one first opening in which one first element is chosen as a second electrode, in which said frame is partly covered with a sealing and electric insulating material;

a second pressure element;

a bipolar plate;

Having described preferred embodiments of the invention it will be apparent to those skilled in the art that other embodiments incorporating the concepts may be used. These and other examples of the invention illustrated above are intended by way of example only and the actual scope of the invention is to be determined from the following claims.

Examples

Example 1

Compressibility Testing

Figure 4:
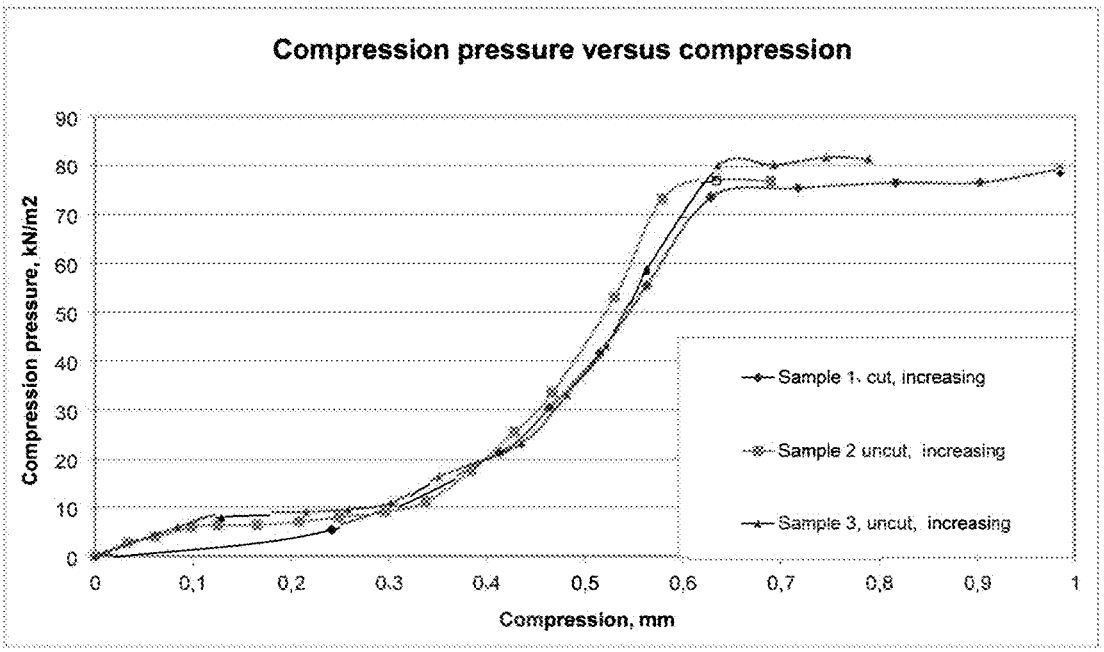
FIG. 4 illustrates compression curves for pressure element according to example 1 of the present application

The compressibility was measured on an area of 4×27 $cm^2$, first on a sample cut to size, and subsequently on the same area in the middle of the element, two parallels. The results of the compression tests are shown in FIG. 4. It is readily seen from FIG. 4 that the element behaves "sinusoidically" up to a compression of about 0.6 mm, where after it behaves "trapezoidically". The results from the sample cut to size and those from the uncut sample are very similar, and demonstrate that reliable measurements can be made on small samples cut to size as well as on areas on uncut elements.

Figure 5:
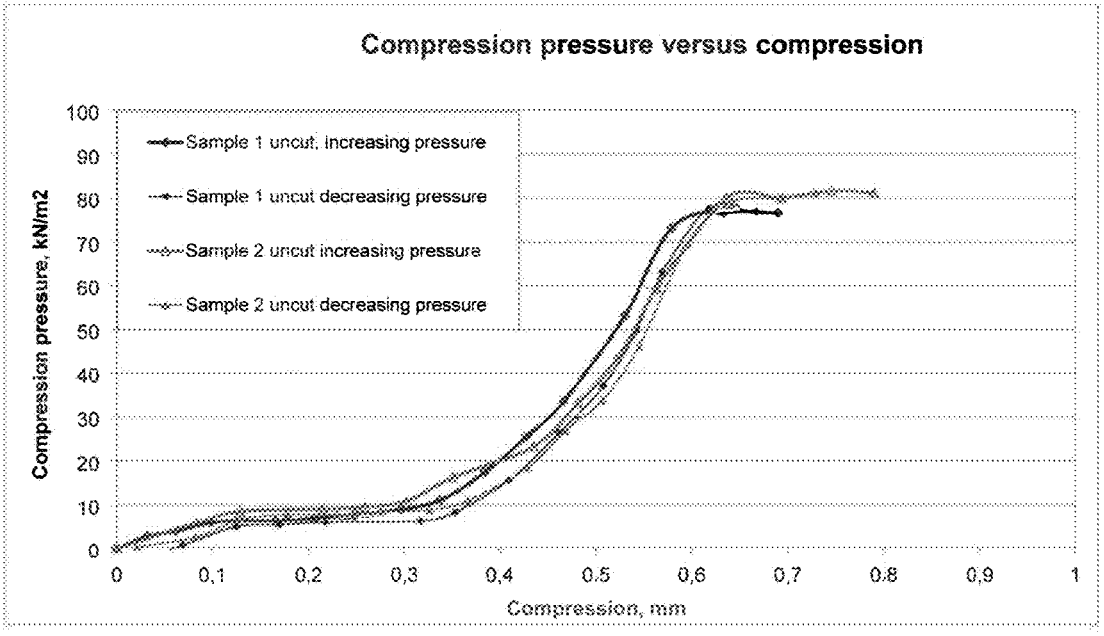
FIG. 5 illustrates a test of compression and reversibility according to example 2 of the present application.

The sample cut to size was compressed to 1 mm and became permanently deformed. The two parallels on the uncut sample also decompressed as shown in FIG. 5. The first sample was compressed about 0.7 mm and the second about 0.8 mm. As readily seen from FIG. 5, the upper flat part of the curve was completely reversible, even up to 0.8 mm compression. This means that the compression element, behaves like a constant pressure element after compression in the cell stack. For the electrical contacts that the pressure element is designed to maintain, this is the perfect situation. Variations in temperature and compression will have only very minor effects on the pressure on the cell stack components and the electrical contacts will be stable.

The invention claimed is:

1. A module for an electrolyser of filterpress type comprising at least one closed frame defining at least one first opening, wherein the module comprises a sealing and electric insulating material, where said material at least partly covers a surface of the at least one closed frame, wherein at least one first element is placed around the at least one closed frame by a sealing and electric insulating material such that the at least one element is free from mechanical connection to the at least one closed frame, wherein the at least one first element is selected from at least one of the following: a diaphragm, a bi-polar plate, pressure element, and electrodes.

2. The module according to claim 1, wherein the material provides sealing against a possible adjacent module or an end section of said electrolyser.

3. The module according to claim 1, wherein the frame comprises at least one of the following: metal, structured plastic, reinforced plastic, thermoset plastic.

4. The module according claim 1, wherein the module comprises at least one positioning means.

5. The module according to claim 1, wherein the module comprises at least one supply channel.

6. The module according to claim 5, wherein the at least one supply channel is covered with a sealing and electric insulating material.

7. The module according to claim 5, wherein the at least one supply channel is connected with at least one first opening by at least one separate transfer channel.

8. The module according to claim 7, comprising at least two separate collecting channels that are connected with at least one first opening by at least two separate transfer channels and the at least two separate transfer channels are each connected to each side of said at least one first opening.

9. The module according to claim 1, wherein the module further comprises at least two separate collecting channels.

10. The module according to claim 9, wherein the at least two separate collecting channels are covered with a sealing and electric insulating material.

11. The module according to claim 9, wherein the at least two separate collecting channels are connected with at least one first opening by at least one separate transfer channel.

12. The module according to claim 1, wherein the at least one first opening is completely or partly covered by the at least one first element.

13. The module according to claim 1, wherein the module comprises a load carrying part of the electrolyser.

14. The module according to claim 1, wherein said pressure element is a fluid-permeable and resilient pressure element.

15. The module according to claim 14, wherein said pressure element possess an inherent conductivity.

16. The module according to claim 14, wherein said pressure element tolerates current density from 0 to 5 A/cm.

17. The module according to claim 14, wherein said pressure element tolerates a compression pressure in at least one of the following ranges: 0.001 to 100 bar, 0.01 to 50 bar, 0.1 to 1.0 bar.

18. The module according to claim 14, wherein said pressure element is fluid permeable in at least two dimensions.

19. The module according to claim 14, wherein said pressure element is resistant to corrosion.

20. The module according to claim 14, wherein said pressure element comprises at least one of the following components: stretched material, perforated foil, mesh or felt fibre mat.

21. A method for producing a module for an electrolyser of filterpress type comprising at least one closed frame defining at least one first opening, the method comprising:

placing at least one first element around the at least one closed frame by a sealing and electric insulating material, wherein the at least one first element is selected from at least one of the following: a diaphragm, a bi-polar plate, pressure element, and electrodes; and at least partly covering the surface of said frame with the sealing and electric insulating material such that the at least one element is free from mechanical connection to the at least one closed frame.

22. The method according to claim 21, further comprising providing sealing with said material against a possible adjacent module or an end section of said electrolyser.

* * * * *